US006409906B1

(12) United States Patent
Aoun

(10) Patent No.: US 6,409,906 B1
(45) Date of Patent: Jun. 25, 2002

(54) ELECTROPLATING SOLUTION FOR PLATING ANTIMONY AND ANTIMONY ALLOY COATINGS

(75) Inventor: Chalo Matta Aoun, Carrollton, TX (US)

(73) Assignee: Frank C. Danigan, Dallas, TX (US)

( * ) Notice: Subject to any disclaimer, the term of this patent is extended or adjusted under 35 U.S.C. 154(b) by 0 days.

(21) Appl. No.: 09/696,149

(22) Filed: Oct. 25, 2000

Related U.S. Application Data

(62) Division of application No. 09/347,943, filed on Jul. 6, 1999.

(51) Int. Cl.[7] ..... C25D 3/02; C25D 3/56

(52) U.S. Cl. ..... 205/239; 205/238; 205/315

(58) Field of Search ..... 205/238, 239, 205/255, 259, 260, 315

(56) References Cited

U.S. PATENT DOCUMENTS

| | | | | |
|---|---|---|---|---|
| 2,779,725 A | | 1/1957 | Smart | |
| 2,813,065 A | * | 11/1957 | DuRose | 204/45 |
| 3,857,683 A | | 12/1974 | Castonguay | 29/195 |
| 3,881,919 A | | 5/1975 | Hyner et al. | 75/175 |
| 3,966,564 A | | 6/1976 | Hyner et al. | |
| 4,016,051 A | | 4/1977 | Geldzahler et al. | |
| 4,029,556 A | | 6/1977 | Monaco et al. | |
| 4,199,417 A | | 4/1980 | Borruso | 204/44 |
| 4,430,171 A | | 2/1984 | Lemke et al. | |
| 4,518,469 A | * | 5/1985 | Ng et al. | 204/445 |
| 4,889,602 A | | 12/1989 | Oshima et al. | |
| 5,232,575 A | | 8/1993 | Dodd | |
| 5,296,128 A | | 3/1994 | Gernon et al. | 205/254 |
| 5,389,226 A | | 2/1995 | Scruggs et al. | |
| 5,421,990 A | * | 6/1995 | Hahn et al. | 205/246 |
| 5,525,206 A | | 6/1996 | Wieczerniak et al. | |
| 6,017,438 A | * | 1/2000 | Takayama et al. | 205/133 |

OTHER PUBLICATIONS

F.A. Lowenheim, Electroplating, McGraw–Hill Book Co., New York, pp 135, 1978.*

"A Low Environmental Risk Replacement for Chromium and Electroless Nickel" by G. A. Croopick, E.M. Scruggs & J. Donaldson; *Metal Finishing*, Apr. 994, Elsevier Science, Inc.

SAE ARP5130—Aerospace Recommended Practice; "Requirements for Alternative Coatings Used in Lieu of Nickel–Chromium Plating for Aerospace Hand Tools", Society of Automotive Engineers, Inc. 1997 Month of publication not available.

ASTM D5281–92 "Standard Test Method for Collection and Analysis of Hexavalent Chromium in Abient Workplace or Indoor Atmospheres"; 1992 Month of publication not available.

"Tin Coatings: Present and Future" by A. H. Chapman, W. B. Hampshire and D. J. Maykuth; *Plating and Surface Finishing*, Jul., 1988.

Plating and Surface Finishing Journal of the American Electroplaters and Surface Finishers Society, Inc., Aug. 1998—vol. 85, No. 8 Alloys are Promising as Chromium or Cadmium Substitutes, George F. Shahin, CEF.

An AESF Education Course: Use of the Hull Cell & Other Plating Cells to Test Solutions: American Electroplaters and Surface Finishers Society; The Worldwide Educational Resource for Surface Finishers: Copyright 1996, Month of publication not available, Marilyn K. Sanicky, McGean–Rohco, Inc.

*Iron–Antimony Alloy Deposition From Citrate Solutions*, Y. N. Sadana and R. Kumar, Plat Surf Finish APR 1979, vol. 66, No. 4.

*Electrodeposition of Alloys–X*: Electrodeposition of Sb–Co Alloys*—Y. N. Sadana and R. Kumar, Surface Technology, vol. 11, 1980 Month of publication not available.

Chemical Abstracts, vol. 83, No. 18, Mar. 11, 1975 Columbus, Ohio—Abstract No. 154548—*Conditions For The Electrodeposition of a Lead–Antimony Alloy From a Tetrafluoroboric Acid (HBF4) Electrolyte*, V. V. Bogoslovskii, et al.

*Bright Antimony Plating*, D. M. Kulikova, N. V. Gudin and S. V. Kubasova, Prot Met; Protection of Metals (English translation of Zaschita Metallov, Nov. 1988, vol. 24, No. 2.

Tin–Based Chromium–Like Finishes, Jacob Hyner, Plat Surf Finish, Feb. 1977, vol. 64, No. 2.

* cited by examiner

*Primary Examiner*—Donald R. Valentine
*Assistant Examiner*—William T. Leader
(74) *Attorney, Agent, or Firm*—F. Lindsay Scott

(57) ABSTRACT

A method and an aqueous electroplating solution for plating tarnish-resistant bluish-white antimony or antimony alloys containing at least one other metal from an aqueous acidic solution having a pH below about 6.0 at a temperature from about 65 to about 140° F.

20 Claims, No Drawings

ELECTROPLATING SOLUTION FOR PLATING ANTIMONY AND ANTIMONY ALLOY COATINGS

This is a division, of application Ser. No. 09/347,943 dated Jul. 6, 1999, still pending

BACKGROUND AND FIELD OF THE INVENTION

This invention relates to a new electroplating solution and method for plating tarnish-resistant, bluish-white antimony and antimony alloys. The antimony and antimony alloys have the appearance of decorative "hexavalent chrome" electro-deposited coatings.

DESCRIPTION OF THE PRIOR ART

Electrically deposited coatings are widely used to protect substrate articles in wear-inducing or corrosive environments, as decorative coatings, as tarnish- or corrision-resistant coatings and for many other purposes. The substrate is conductive or has been rendered conductive by electroless plating or the like and is formed to the required shape and dimensions. An electrically deposited coating may be placed on the article prior to depositing an exterior coating or as an exterior coating. The electrically deposited coating is chosen to provide the required combination of strength, toughness, ductility, appearance and other properties and to protect the surface of the article against hostile environments, wear and the like. The coating must possess the desired properties and adhere well to the article.

One of the most widely used coatings is the nickel-chrome, where chrome refers to chrome coatings electroplated from a plating solution containing hexavalent chromium ions onto bright nickel. The hexavalent chrome coatings have a bluish-white, tarnish-resistant appearance which is much desired for many applications. Most of the proposals to date have failed to provide electroplated coatings equivalent to electroplated hexavalent chrome coatings.

The use of electroplated hexavalent chrome coatings has become a problem in recent years because of the serious environmental problems related to solutions containing hexavalent chrome ions. Hexavalent chrome ion-containing solutions are considered to be a toxic pollutant and extensive regulations have been developed to monitor their use and disposition. As a result, a continuing search has been directed to the development of substitute electroplating solutions which can be used to produce electroplated coatings equivalent to hexavalent chrome coatings in appearance and properties, but which do not utilize materials regarded as a toxic pollutant.

Further, hexavalent chrome plating solutions are not suitable for use in barrel plating. Barrel plating requires that a number of relatively small, electrically conductive parts be placed in a barrel so that the parts are cathodic and tumble into and out of electrical contact with other parts contained in the barrel with at least one anodic surface. Since current interruption is detrimental to electroplating chrome from hexavalent chrome ion-containing plating solutions, hexavalent chrome plating has not been considered suitable for use in barrel plating.

Numerous plating techniques, solutions, and alloys have been considered in attempts to replace the widely used bluish-white hexavalent chrome coatings. The first choice was trivalent chromium electroplating solution, but the deposit obtained from this solution is dark because of the iron presence in the deposit. The alloys created for this purpose did not provide the bluish non-tarnishing white color, either. The most known alloys in this order are: "tin-nickel"; "tin-cobalt", U.S. Pat. No. 3,966,564"; and "nickel-tungsten-boron", U.S. Pat. No. 5,389,226.

Since the hexavalent chrome coatings are considered to be extremely desirable because of their decorative appearance, their wear and abrasion properties, their tarnish-resistance and their other desirable properties, a continuing search has been directed to the development of electroplating techniques and materials which can produce electroplated coatings equivalent to hexavalent chrome coatings without the environmental problems associated with current hexavalent chrome ion-containing electroplating solutions.

SUMMARY OF THE INVENTION

It is now been found that coatings which have an appearance and tarnish-resistance virtually indistinguishable from hexavalent chrome coatings can be produced from an acidic aqueous electroplating solution for electroplating a metallic coating onto an electrically conductive substrate, the coating comprising at least about 65 weight percent antimony, the solution containing from about 0.5 to about 120 g/l (grams per liter) of antimony, at least one acid in an amount sufficient to maintain the pH of the solution below about 6.0, a complexer and a wetter.

The solution may also contain at least one other metal in an amount equal to from about 0.001 to about 2.0 molar (M) and may be used to produce alloys containing at least about 65 weight percent antimony and at least about 0.1 weight percent of the at least one other metal.

The alloys may contain antimony and more than one other metal.

The invention further comprises electrically conductive articles at least partially coated with a bluish-white, tarnish-resistant electroplated coating having the appearance of a hexavalent chrome coating and comprising one of antimony and antimony alloys with other metals.

DESCRIPTION OF PREFERRED EMBODIMENTS

This invention relates to the use of antimony as a single electrodeposited metal, or in an alloy with Ni (0.1—35% Ni metal) and other metals as a chrome substitute, to aqueous electrolytic baths from which the metallic deposits are obtained, to the process to form the deposits and to the deposits. The chrome electrodeposited from an aqueous solution where the chrome ion is hexavalent has a superior white bluish color and is called in the electroplating industry "hexavalent chrome". As the restrictions from EPA, and the clean air act on the hexavalent chrome become more and more severe, countless alternatives were developed in attempts to match the desirable hexavalent chrome properties which are appearance, excellent adhesion, abrasion and tarnish- and corrosion-resistances.

The first choice was the "trivalent chrome", which is chrome metal deposited from an aqueous solution where the chrome ion is in the trivalent form. The "trivalent chrome" meets all the "hexavalent chrome" requirements except the color, which is dark because of the presence of iron in the deposit.

Many alloys were created to fulfill the hexavalent chrome specifications, like tin-nickel binary alloy in acidic bath. The tin-nickel alloy was used in the fifties in very acidic solution pH=0.5 and high fluoride content, the color of the deposit was red. The chemical composition of the bath was modified many times, the most recent modification was not red but still showed some pink variations.

Other alloys like tin-cobalt binary or ternary alloys pH=1–3, U.S. Pat. No. 3,966,564, and the nickel-tungsten, boron alloy pH=6–9, U.S. Pat. No. 5,389,226, are major techniques actually used as chrome substitutes. The color of these alloys is yellowish-white and their properties are more nickel-like than chrome-like.

All these alloys added the barrel application option to the classical chrome plating technology, but failed to match the bluish silvery color obtained from a hexavalent chrome bath. This can be explained by the fact that the metals used in these alloys are yellowish-white in their elemental form.

Antimony is a silver, bluish, tarnish-resistant metal in its elemental form. Before this invention, antimony was not used as a primary or a secondary metal in chrome substitute alloys.

As elemental metal, antimony is a white, blue, silvery, non-tarnishing metal, but it is brittle. Antimony acidic solutions are used by immersion to coat steel with a black film prior to phosphate paint base coating. Few attempts have been made to electroplate antimony and none of them is considered to produce a coating comparable to hexavalent chrome coatings.

According to the present invention, it has been found that bluish-white antimony electroplated deposits having the appearance of a hexavalent chrome coating and comprising at least about 65% antimony can be produced from an acidic, aqueous electroplating solution containing from about 0.5 to about 120 g/l of antimony and at least one acid in an amount at least sufficient to maintain the pH of the solution below about 6.0, a complexer and a wetter. Antimony deposits containing as low as about 65 weight percent antimony may be produced, but deposits containing less than about 75 weight percent antimony may not have the appearance of a hexavalent chrome coating. The electroplating solution may also be used to produce alloys of antimony which retain the bluish-white color, tarnish-resistant properties and hexavalent chrome coating appearance of the antimony coatings. The alloys have different properties with respect to their corrosion resistance and the like, dependent upon the alloy metal selected.

Suitable acids are selected from the group consisting of hydrochloric acid, hydrofluoric acid, hydrobromic acid, hydriodic acid, fluoboric acid, sulfuric acid, nitric acid, acetic acid, phosphoric acid, citric acid, glycolic acid, succinic acid, lactic acid, salicylic acid, sulfamic acid, boric acid, tartaric acid, malic acid, maleic acid, propionic acid, gluconic acid, ascorbic acid, methacrylic acid and phenol sulfonic acid and the like. Preferred acids are hydrochloric acid, fluoboric acid, sulfamic acid, phosphoric acid, hydrobromic acid, hydriodic acid, hydrofluoric acid, mixtures thereof and the like.

The complexer may be selected from the group consisting of alkyl amines, reaction products of alkyl amines with mineral or organic acids, quaternary ammonium salts, arylamines, heterocyclic tertiary amines, amino acids, amides and other compounds including an amino nitrogen moiety and mixtures thereof. Preferred complexers are ethylenediamine, pyridine and pyridine derivatives, ethanolamines, glycine, valine, cysteine, urea, anmmonia salts such as ammonium halides and mixtures thereof.

The wetter is selected from the group consisting of ethoxylated alcohols, alkanol amines, alkanolamides, alcohol sulfates, ethoxylated alkyl phenols, ethoxylated fatty acids, alkylsulfonates, alkylsulfosuccinates, perfluoroalkylsulfonates, fatty acid ethoxylates, propylene oxide/ethylene oxide block copolymers, and mixtures thereof. Most surfactant materials suitable to achieve the desired surface tension adjustments may be used in the solution. Preferred wetters are selected from the group consisting of nonylphenol ethoxylates, alkylsulfosuccinates, perfluoroalkylsulfonates, alkylsulfates and mixtures thereof.

The solution may also optionally include a brightener which is selected from the group consisting of gelatin, cinnamic acid, benzoic acid, nicotinic acid, thiourea, polyacrylamides, thiocarbamides, catechol, saccharin, napthalene, trisulfonic acid, propargyl alcohol, butynediol, propoxylated acetylenic alcohol and mixtures thereof. Preferred brighteners are selected from the group consisting of benzoic acid, saccharin and nicotinic acid and their derivatives and mixtures thereof. A wide variety of brighteners may be used, as known to those skilled in the art, based upon their ability to produce smooth grained, level deposits and the like.

The solution is desirably operated at a temperature from about 65 to about 140° F. and preferably from about 80 to about 120° F.

The pH of the solution is desirably below about 6.0 and preferably below about 4.0 and is more preferably from 0 to about 2.5.

Plating from the solution is desirably at an amperage from about 0.5 to about 300 amps per square foot of surface area (ASF) of the articles to be coated. The current density is typically from about 1 to about 100 ASF and preferably from about 3 to about 50 ASF with articles which are racked as known to those skilled in the art and plated in a plating tank of a suitable size containing the electroplating solution. By contrast to hexavalent chrome electroplating solutions which have poor throwing power, the electroplating solution of the present invention has excellent throwing power and enables the plating of parts with recessed areas and the like.

When barrel plating is used, the current density is desirably from about 1 to about 30 ASF and preferably from about 3 to about 20 ASF based upon the surface area of the parts plated. The electroplating solution of the present invention is suitable for use in barrel plating since it is relatively unaffected by current interruptions when plating. This enables the production of small articles such as fittings, bolts, nuts and other small parts which are suitably plated by barrel plating but which are difficulty plated by the usual racking techniques required for hexavalent chrome plating. Hexavalent chrome coatings cannot be plated in a barrel. Hexavalent chrome coatings require racking the parts to be plated which is a high expense requirement for small parts.

The complexer, wetter and brightener are adjusted as well known to those skilled in the art by the use of actual plating tests to determine whether the electroplating solution contains a sufficient amount of these materials to have the desired throwing power, leveling power and the like, and the desired brightness, appearance and composition of the deposit, and the like. The current and operating temperature of the bath may affect the amount of complexer, brightener and wetter required. Typically, the brightener is present in the solution in an amount from about 0.1 mg/l to about 10 g/l. Typically, the complexer is present in the. solution from about 0.01M to about 4M and preferably from about 0.1M to about 1.5M. Similarly, the wetter is typically present in the solution in an amount equal to from about 0.05 to about 10 g/l. The quantity of the complexer, wetter and brightener may all be adjusted by fine tuning the performance of the bath by actual plating tests in test cells or by observation of the electroplated deposits with the bath in operation and adjusting the quantities of the complexer, wetter and optionally the brightener. As previously stated, the required quantities of these materials may vary substantially depending upon the current density used, the bath temperature, the pH of the bath, and the like.

The bath may be used to plate antimony and alloys of antimony. The antimony alloys are deposits comprising at least about 65 weight percent antimony and at least about 0.1 weight percent of at least one other metal selected from the group consisting of tin, nickel, iron, cobalt, zinc, indium, bismuth, lead, cadmium, palladium, titanium, vanadium, copper, molybdenum, tungsten, germanium and mixtures thereof. A plurality of other metals may be included in the alloy by including all of the metals to be included in the alloy in the plating solution. The metals, of course, are present in the plating solution in the form of ions resulting from the addition of the metals, preferably as salts of the acids in the solution, to the solution. In some instances, it may be possible to replenish the metal ions in the solution by the use of dissolving anodes but, in most instances, it is believed that it will be found preferable to use insoluble anodes and replace the metal ions by analysis and replenishment to maintain the composition of the bath. A wide variety of tarnish-resistant, bluish-white alloys having the appearance of hexavalent chrome coatings can be produced by the selection of alloying metal or metals. Antimony alloys containing less than about 75 weight percent antimony may be less bluish-white than similar alloys containing more than 75 weight percent antimony, but such alloys are. still tarnish-resistant and are useful in applications requiring tarnish- and corrosion-resistance such as a replacement for cadmium plating and the like.

The bath composition desirably comprises at least one acid of the groups listed above, antimony in an amount equal to from about 0.5 to about 120 g/l, a complexer and a wetter. The complexer and the wetters have been described above and composition ranges have been given for these materials. The acid is desirably present in the solution in an amount equal to at least 2 moles of acid per mole of antimony.

Further, when alloys are plated, it is desirable that each of the alloy metals be present in the plating solution in an amount from about 0.001 to about 2M. The amount of antimony and the other metal are varied, depending upon the desired composition in the resulting alloy. Comparable current densities, times and temperatures to those used for depositing the antimony are used when plating the alloys.

A particularly desirable alloy is an alloy of nickel and antimony with the nickel being present in the solution as divalent nickel and in the alloy in an amount up to about 35 weight percent of the alloy. These deposits have a bluish-white hexavalent chrome coating appearance, tarnish-resistance, and the like, which are virtually indistinguishable from hexavalent chrome plated coatings, short of chemical analysis. Many of the other metals listed also produce deposits comparable to hexavalent chrome coatings. Desirably the alloys contain from about 65 to about 99.9 weight percent antimony and from about 0. 1 to about 35 weight percent nickel.

The antimony/nickel alloys according to the present invention have desirable properties of appearance, hardness, wear resistance, corrosion resistance, resistance to acid atmospheres, ductility, tarnish-resistance and the like. These alloys are considered to be a fully acceptable replacement for hexavalent chrome electroplated deposits for decorative or protective coatings. It is considered that in all respects these alloys are a suitable replacement for hexavalent chrome plated coatings.

The bath is desirably agitated either mechanically, with air or with an inert gas. The emissions from the bath must, of course, be controlled but are not considered to constitute an environmental pollutant of the toxicity of hexavalent chrome.

The plating times may be varied as desired to deposit coatings of various thicknesses. Typically, hexavalent chrome deposit thicknesses vary from about 5 to about $50\times10^{-6}$ inches, with more typical coating thicknesses being from about 20 to about $25\times10^{-6}$ inches. The coatings in this range, or thicker or thinner coatings, may be produced from the present solution by selection of a suitable plating time. Such variations are well known to those skilled in the art.

Representative electroplating solutions within the scope of the present invention are shown as follows. The plating amperages in ASF, plating time in minutes and solution temperatures during plating are shown.

EXAMPLE 1

| Plating Antimony | |
|---|---|
| Antimony trioxide | 4.4 g/l |
| Hydrochloric acid | 33.6 ml/L |
| Ammonium Bifluoride | 11.52 g/l |
| Amineperfluoroalkylsulfonate | 0.5 ml/L |
| 10 ASF, 1 min. 75° F. | |

EXAMPLE 2

| Plating Antimony/Zinc Alloy | |
|---|---|
| Antimony trioxide | 20 g/l |
| Hydrochloric acid | 120 ml/L |
| Zinc chloride | 30 g/l |
| Ammonium bifluoride | 46 g/l |
| Amino acid | 11.56 g/l |
| Pyridinium propylsulfonate | 3.5 g/l |
| Propylene oxide/ethylene oxide block copolymer | 0.5 g/l |
| Ammonium benzoate | 1.33 g/l |
| Plates at 30 ASF for 30 sec to 1 min. at 120° F. | |

EXAMPLE 3

| Plating Antimony and Nickel | |
|---|---|
| Antimony chloride | 10 g/l |
| Ammonium chloride | 60 g/l |
| Hydrochloric acid | 80 ml/L |
| Nickel chloride, hexahydrate | 200 g/l |
| Diethylenetriamine | 3 g/l |
| L-Cystine hydrochloride | 1 g/l |
| Sodiumalkylsulfosuccinate | 0.2 g/l |
| Plates at 5 ASF, 3 min., 90° F. | |

The solutions shown are illustrative representative solutions within the scope of the present invention.

Having thus described the present invention by reference to its preferred embodiments, it is respectfully pointed out that many variations and modifications are possible within the scope of the present invention. Many such variations and modifications may be considered obvious and desirable by those skilled in the art based upon a review of the foregoing description of preferred embodiments.

I claim:

1. An acidic aqueous electroplating solution for electroplating a metallic coating onto an electrically conductive substrate, the coating comprising at least about 75 weight percent antimony, the solution containing from about 0.5 to about 120 g/l of antimony, an acid selected from the group consisting of hydrochloric acid, hydrofluoric acid, hydrobromic acid, hydroiodic acid, fluoboric acid, phosphoric acid, sulfamic acid in an amount at least sufficient to maintain the pH of the solution below about 6.0, a complexer selected from the group consisting of pyridine and pyridine derivatives, glycine, valine, cysterine, urea, and ammonium salts and a wetter selected from the group consisting of ethoxylated alcohols, alkanolamines, alkanolamides, alcohol sulfates, ethoxylated alkyl phenols, ethoxylated fatty acids, alkyl sulfonates, alkylsulfosuccinates, perfluoroalkyl sulfonates, fatty acid alcohol ethoxylates and propylene oxide/ethylene oxide block copolymers.

2. The solution of claim 1 wherein the solution contains a brightener selected from the group consisting of gelatin, cinnamic acid, benzoic acid, nicotinic acid, polyacrylamides, thiocarbamides, catechol, saccharin, naphthalene, trisulfonic acid, propargyl alcohol, butynediol, propoxylated acetylenic alcohol and mixtures thereof.

3. The solution of claim 2 wherein the brightener is selected from the group consisting of propargyl alcohol, butynediol, acetylenic alcohol and mixtures thereof.

4. The solution of claim 2 wherein the complexer is an ammonium salt.

5. The solution of claim 2 wherein the complexer is glycine, valine, cysterine, urea, and ammonium salts.

6. The solution of claim 1 wherein the coating comprises at least about 75 weight percent antimony and wherein the coating is bluish-white and tarnish resistant.

7. The solution of claim 1 wherein the wetter is selected from the group consisting of nonyl phenol ethoxylates, alkylsulfosuccinates, perfluoroalkylsulfonates alkylsulfate and mixtures thereof.

8. The solution of claim 1 wherein the coating is a bluish-white alloy and contains at least about 75 weight percent antimony and at least about 0.1 weight percent of at least one other metal and wherein the solution further contains each at least one other metal in an amount from about 0.001 to about 2M, the other metal being selected from the group consisting of tin, iron, nickel, cobalt, zinc, indium, bismuth, lead, cadmium, palladium, titanium, vanadium, copper, molybdenum, tungsten, germanium and mixtures thereof.

9. The solution of claim 8 wherein the other metal is nickel and wherein the nickel is present in the solution as divalent nickel and wherein the coating is a bluish-white, tarnish-resistant allay coating having the appearance of a hexavalent chrome coating and containing from about 75 to about 99.9 weight percent antimony and from about 0.1 to about 25 weight percent nickel.

10. The solution of claim 8 wherein the coating is a bluish-white alloy and contains at least about 0.1 weight percent of each of at least two other metals and wherein the solution contains each of the other metals in an amount from about 0.001 to about 2M.

11. The solution of claim 1 wherein the pH is from about 0 to about 4.

12. The solution of claim 1 wherein the complexer is glycine or urea.

13. An acidic aqueous electroplating solution for electroplating an antimony coating onto an electrically conductive substrate, the solution containing from about 0.5 to about 120 g/l of antimony, an acid selected from the group consisting of hydrochloric acid, fluoboric acid, sulfamic acid, phosphoric acid, hydrobromic acid, hydroiodic acid and hydrofluoric acid in an amount at least sufficient to maintain the pH of the solution below about 6.0, a complexer selected from the group consisting of ethylenediamine, pyridine and pyridine derivatives, glycine, valie, cysteine, urea and ammonium salts in an amount from about 0.01M to about 4M and a wetter selected from the group consisting of nonyl phenol ethoxylates, alkylsulfosuccinates, perfluoroalkylsulfonates, alkylsulfate and mixtures thereof.

14. The solution of claim 13 wherein the solution further contains a brightener selected from the group consisting of propargyl alcohol, butynediol and acetylenic alcohol.

15. The solution of claim 13 wherein the acid is hydrochloric acid, the complexer is ammonium bifluoride and the wetter is amine perfluoralkylsulfonate.

16. An acidic aqueous electroplating solution for electroplating an antimony alloy coating wherein the alloy contains at least about 75 weight percent antimony onto an electrically conductive substrate, the solution consisting essentially of from about 0.5 to about 120 g/l of antimony, an acid selected from the group consisting of hydrochloric acid, fluoboric acid, sulfamic acid, phosphoric acid, hydrobromic acid, hydroiodic acid and hydrofluoric acid in an amount at least sufficient to maintain the pH of the solution below about 6.0, a complexer selected from the group consisting of ethylenediamine, pyridine and pyridine derivatives, glycine, valine, cysteine, urea and ammonium salts in an amount from about 0.01M to about 4M and a wetter selected from the group consisting of nonyl phenol ethoxylates, alkylsulfosuccinates, perfluoroalkylsulfonates, alkylsulfate and mixtures thereof.

17. The solution of claim 16 wherein the solution further contains a brightener selected from the group consisting of propargyl alcohol, butynediol and acetylenic alcohol.

18. The solution of claim 16 wherein the solution further contains at least one other metal and wherein the alloy contains at least one other metal in an amount equal to from about 0.1 to about 25 weight percent.

19. The solution of claim 18 wherein the acid is hydrochloric acid, the other metal is zinc, the alloy is an alloy of antimony and zinc, the complexer is ammonium bifluoride, and the wetter is pyridinium propylsulfonate.

20. The solution of claim 18 wherein the other metal is nickel, the alloy is an alloy of antimony and nickel, the acid is hydrochloric acid, the complexer is ammonium bifloride and the wetter is sodium alkylsulfosuccinate.

* * * * *

UNITED STATES PATENT AND TRADEMARK OFFICE

CERTIFICATE OF CORRECTION

PATENT NO. : 6,409,906 B1
DATED : June 25, 2002
INVENTOR(S) : Chalo Matta Aoun

It is certified that error appears in the above-identified patent and that said Letters Patent is hereby corrected as shown below:

Title page,
Item [73], Assignee, please correct the name of the Assignee from "Frank C. Danigan" to read -- Frank C. Dunigan --

Column 7,
Line 57, please change the word "allay" to read -- alloy. --

Column 8,
Line 19, please change the word "valie" to read -- valine. --

Signed and Sealed this

Sixth Day of August, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,409,906 B1
DATED : June 25, 2002
INVENTOR(S) : Chalo Matta Aoun

It is certified that error appears in the above-identified patent and that said Letters Patent is hereby corrected as shown below:

Column 1,
Line 21, please correct the word "corrision" to the correct spelling of -- corrosion. --

Signed and Sealed this

Twenty-ninth Day of October, 2002

*Attest:*

*Attesting Officer*

JAMES E. ROGAN
*Director of the United States Patent and Trademark Office*